US007517139B2

(12) United States Patent
Hiranuma et al.

(10) Patent No.: US 7,517,139 B2
(45) Date of Patent: Apr. 14, 2009

(54) PORTABLE TIMEPIECE

(75) Inventors: Haruki Hiranuma, Chiba (JP); Koremoto Takeda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/827,067

(22) Filed: Jul. 10, 2007

(65) Prior Publication Data

US 2008/0025158 A1 Jan. 31, 2008

(30) Foreign Application Priority Data

Jul. 25, 2006 (JP) ..... 2006-201939

(51) Int. Cl.
*G04B 37/00* (2006.01)
*G04B 29/00* (2006.01)

(52) U.S. Cl. ..... 368/288; 368/308; 368/319

(58) Field of Classification Search ..... 368/187, 368/288–290, 306–308
See application file for complete search history.

(56) References Cited

U.S. PATENT DOCUMENTS 546,543 A * 9/1895 Kohli ..... 368/308
6,315,443 B1 * 11/2001 Meyrat et al. ..... 368/290
2005/0207286 A1 9/2005 Hiranuma et al.

FOREIGN PATENT DOCUMENTS

JP 2000-187083 7/2000
JP 2000 - 187083 * 7/2000

* cited by examiner

*Primary Examiner*—Vit W Miska
*Assistant Examiner*—Sean Kayes
(74) *Attorney, Agent, or Firm*—Adams & Wilks

(57) ABSTRACT

A portable timepiece has a timepiece movement and a movement interlock axle that undergoes linear movement and undergoes rotational movement to transmit a rotational force to the timepiece movement. An external operation body is operable to linearly move and rotate the movement interlock axle. A stopper member undergoes movement between a first position in which the stopper member is engaged with an engagement part of the movement interlock axle to prevent linear movement thereof and a second position in which the stopper member is not engaged with the engagement part to permit linear movement. An operation body undergoes movement in a first direction to engage the stopper member and cause the stopper member to move to the first position to engage the engagement part of the movement interlock axle, and undergoes movement in a second direction in which the operation body is disengaged from the stopper member to cause the stopper member to move to the second position to disengage from the engagement part of the movement interlock axle.

20 Claims, 6 Drawing Sheets

PORTABLE TIMEPIECE

BACKGROUND OF THE INVENTION

1. Field of the Invention

The present invention relates to a portable timepiece, such as a wristwatch or a pocket watch, in which an armor case of a timepiece armor assembly forms a one-piece structure.

2. Description of the Prior Art

In a wristwatch in which an armor case is a one-piece structure, since the timepiece armor assembly does not have a case back, it is advantageous to provide a design in which a peripheral part back face side of the timepiece armor assembly is tapered, thereby visually showing a periphery part of the timepiece armor assembly thinly.

In the wristwatch of this kind, similarly to the wristwatch having the case back, for a repair and the like there is provided a contrivance for removing a movement interlock axle such as winding stem from a timepiece movement in the armor case.

As the contrivance of this kind, hitherto, a setting lever is rotatably supported to a setting lever axle having been attached to a main plate of the timepiece movement, and one end part of a lever for setting lever is provided while being overlapped to this setting lever. The other end part of the lever for setting lever protrudes in a planar form from an external shape of a dial of the timepiece movement, and is disposed in an annular interstice having been formed between a peripheral edge of the dial and an annular face opposed to a dial peripheral face of an edge member that an armor cover has. The other end part of this lever for setting lever is covered by an edge member having supported a glass of the timepiece armor assembly, and exposed so as to be operable by removing the edge member. And, by pressing down the other end part of the exposed lever for setting lever from a front face side of the timepiece armor assembly toward a back face side by a tweezers or the like, it is possible to move the setting lever following upon the lever for setting lever is slanted. By a movement of the setting lever at this time, its stopper part is disengaged from an engagement part of the winding stem, and retention of the winding stem is released. Accordingly, under this state, it is possible to pull out the winding stem through a crown (e.g., refer to Japanese Patent No. 3213892 Gazette (paragraphs 0002-0005, FIG. 1-FIG. 6)).

Hitherto, besides this, there is known a contrivance in which an engagement/disengagement operation body having an advance/retreat member moved in a thickness direction of the timepiece armor assembly by a rotation operation is provided in a case bottom wall of the armor case of one-piece structure, a movable axle generally referred to as a setting lever pin is interlocked with the advance/retreat member, and an engagement member having been generally referred to as the lever for setting lever and supported to the movable axle is moved. In this contrivance, by moving the advance/retreat member from the back face side of the timepiece armor assembly toward the front face side, since a stopper part of the engagement member can be removed from a groove of the winding stem, under this state it is possible to pull out the winding stem through the crown (e.g., refer to JP-A-2005-265755 Gazette (paragraphs 0018-0041, FIG. 1-FIG. 7)).

In a technique of the Patent Document 1, in which it is necessary to protrude the other end part, that is an operation part of the lever for setting lever, in the planar form from the external shape of the dial, there is such a problem that, unless an external shape of the timepiece armor assembly is made large, a size (parting diameter) of the dial undergoes a restriction by the lever for setting lever.

In a technique of the Patent Document 2, which can improve such a problem, there is the following problem. That is, the engagement/disengagement operation body attached to the case bottom wall of the armor case of one-piece structure possesses an operation member accommodated in an accommodation hole penetrated through the case bottom wall in a thickness direction and rotation-operated from an outside, and the advance/retreat member rotation-stopped in the accommodation hole by being screwed to an upper part of the operation member and protruded upward in the armor case, and a waterproof gasket ensuring a waterproofness in the accommodation hole is attached to the operation member.

Therefore, to a length of the operation member, there is added by a dimension for ensuring the waterproofness, in other words, a thickness dimension of the waterproof gasket. And, a height dimension of the accommodation hole of the case bottom wall accommodating this operation member is determined by considering, besides for the length of the operation member, a stroke dimension of the advance/retreat member, and the accommodation hole is formed by a height having complied with an accumulation of such dimensions. By this, since a thickness of the case bottom wall becomes comparatively thick, it is disadvantageous in sufficiently bringing about an advantage that the armor case is one-piece structure, in other words, an effect making the design visually showing the periphery part of the timepiece armor assembly thinly.

Additionally, in a self-winding wristwatch, an oscillating weight whose planar shape is approximately a ginkgo's leaf for instance is attached to a bottom face part of the timepiece movement and, by the fact that it is rotated about a vertical axle, there is obtained an energy driving the timepiece movement. In the wristwatch like this, in order to avoid an interference between the advance/retreat member of the engagement/disengagement operation body and the oscillating weight, it is necessary to dispose the engagement/disengagement operation body in a region deviated from a rotation locus of the oscillating weight, in other words, a position nearer to a case barrel part of the armor case. Accordingly, since a site in which a wall thickness of the case bottom wall is thick is approached to the case barrel part, it is disadvantageous in sufficiently bringing about the effect making the design visually showing the periphery part of the timepiece armor assembly thinly.

SUMMARY OF THE INVENTION

It is an object of the present invention to provide a portable timepiece which is made such that a constitution for removing, together with the movement interlock axle such as winding stem, an outside operation body such as crown from the timepiece movement does not become a restriction factor in regard to the size of the dial, and a factor impairing the design visually showing the periphery part of the timepiece armor assembly thinly.

In order to solve the above problems, the present invention possesses a timepiece armor assembly which possesses an armor case of one-piece structure in which a case bottom wall and a case barrel part are monolithically made, and in which a taper face is formed in a peripheral part back face of the armor case, a timepiece movement with a dial, which is built-in in the timepiece armor assembly, a movement interlock axle which is connected to the timepiece movement so as to be insertable/removable from a side, which is built-in in the timepiece armor assembly so as to be movable in a direction intersecting a thickness direction of this armor assembly, and which has a stopper engagement part, an outside operation body which is attached to the case barrel part so as to be detachable from a side while being connected to the movement interlock axle, a stopper member built-in in the timepiece armor assembly, and an engagement/disengagement operation body which is provided in the case barrel part so as to be operable from a side of the case barrel part, and which moves in the direction intersecting the thickness direction of the timepiece armor assembly to thereby interlock the stopper member, thereby causing this stopper member to engage with and disengage from the stopper engagement part.

In this invention, the outside operation body is one represented by the crown for instance, and indicates a member which operates the timepiece movement in an outside of the timepiece armor assembly and from a side, for a time instant setting, a date setting and the like for instance. In this invention, the movement interlock axle is one represented by the winding stem for instance, and indicates a member which transmits an operation of the outside operation body to the timepiece movement, for the time instant setting and the like for instance. Further, in this invention and the following invention, the direction intersecting the thickness direction of the timepiece armor assembly can preferably be set to a radial direction of the timepiece armor assembly, but the invention is not restricted to this.

Further, in order to solve the above problems, the present invention possesses a timepiece armor assembly which possesses an armor case of one-piece structure in which a case bottom wall and a case barrel part are monolithically made, and in which a taper face is formed in a peripheral part back face of the armor case, a timepiece movement with a dial, which is built-in in the timepiece armor assembly, a winding stem which is connected to the timepiece movement so as to be insertable/removable from a side, which is built-in in the timepiece armor assembly so as to be movable in a direction intersecting a thickness direction of this armor assembly, and which has a stopper engagement part, a crown which is attached to the case barrel part so as to be detachable from a side while being connected to the winding stem, a stopper member which is built-in in the timepiece armor assembly, and an engagement/disengagement operation body which is provided in the case barrel part so as to be operable from a side of the case barrel part, and which moves in the direction intersecting the thickness direction of the timepiece armor assembly to thereby interlock the stopper member, thereby causing this stopper member to engage with and disengage from the stopper engagement part.

In these inventions, similarly to the outside operation body represented by the crown for instance, which is connected to the movement interlock axle represented by the winding stem for instance, since the engagement/disengagement operation body is provided in the case barrel part not in a case bottom wall of the armor case of one-piece structure, it is possible to move the stopper member by operating the engagement/disengagement operation body in an outside of the case barrel part and from a side without depending on an operation along the thickness direction of the timepiece armor assembly.

In detail, in these inventions, when disassembling the portable timepiece, in order to remove the movement interlock axle represented by the winding stem for instance from the timepiece movement, there suffices if the engagement/disengagement operation body is moved toward the timepiece movement by operating it from an outside of the case barrel part of the armor case of one-piece structure. By interlocking with it, since the engagement/disengagement operation body moves the stopper member, this stopper member is removed from the stopper engagement part of the movement interlock axle represented by the winding stem for instance, so that there is released a state in which the movement interlock axle represented by the winding stem has been retained so as not to move. Accordingly, under this state, by grasping and pulling out the outside operation body represented by the crown for instance to the outside of the armor case, the movement interlock axle represented by the winding stem can be pulled out from the timepiece movement and pulled out to the outside while being passed through the case barrel part.

And, like the above, since it is possible to operate the engagement/disengagement operation body in the outside of the case barrel part, that the armor case has, and form the side, there is no restriction in dispositions of the engagement/disengagement operation body and the stopper member in regard to the dial. Therefore, there is no fact that the constitution for removing, together with the movement interlock axle such as winding stem, the outside operation body such as crown from the timepiece movement becomes the restriction factor in regard to the size of the dial.

Additionally, from a necessity for disposing the movement interlock axle represented by the winding stem and the outside operation body represented by the crown, a wall thickness of the case barrel part along a radial direction of the timepiece armor assembly is formed sufficiently thick in comparison with a thickness of the case bottom wall. Therefore, it is unnecessary to particularly ensure, in the case barrel part, a wall thickness for attaching the engagement/disengagement operation body to the case barrel part, so that a diameter of the timepiece armor assembly does not become large. And, by the above disposition of the outside operation body, the wall thickness of the case bottom wall can be made thin in comparison with a case where the outside operation body is provided in the case bottom wall and, in a case where the invention is applied to the self-winding portable timepiece, there is also no fear that its oscillating weight interferes with the engagement/disengagement operation body. Therefore, there can be made such that the constitution for removing, together with the movement interlock axle such as winding stem, the outside operation body such as crown from the timepiece movement does not become the factor impairing the design visually showing the peripheral part of the timepiece armor assembly thinly.

In a desirable mode of the present invention, the case barrel part has an operation body attachment hole which comprises a small diameter hole part provided while being brought closer to an inside of the armor case and a large diameter hole part communicating with the small diameter hole part and provided while being brought closer to an outside of the armor case, and in which a female thread part is formed in an inner face of the small diameter hole part, the engagement/disengagement operation body is formed from an axle part, a male thread part provided in an intermediate part outer periphery of the axle part, a taper-like tip part made by one end part of the axle part and capable of pushing the stopper member, and a flange part provided in the other end part of axle part, and has, in the other end part of the axle part, an operation part rotating this axle part, and the engagement/disengagement operation body is attached to the case barrel part by causing the male thread part to mesh with the female thread part to thereby cause the axle part to penetrate through the small diameter hole part and providing the flange part in the large diameter hole part, so that the engagement/disengagement operation body is biased toward an outside of the case barrel part by a bias member disposed in the large diameter hole part.

In the desirable mode of this invention, by the fact that the engagement/disengagement operation body meshed with the case barrel part is biased by the bias member, since a mesh state of the engagement/disengagement operation body to the case barrel part is retained, even if a vibration or an impact is exerted on the timepiece or the flange part is carelessly pushed to a case band inside, the engagement/disengagement operation body is suppressed from moving toward the timepiece movement. Therefore, other than when contriving a disassembly of the portable timepiece, there is no fact that the stopper member is pushed by the taper-like tip part of the engagement/disengagement operation body and, therefore, there can be made such that the movement interlock axle represented by the winding stem is not removed carelessly.

Further, in a desirable mode of the present invention, a waterproof ring pushed by the bias member is disposed in a step part formed in a boundary between the small diameter hole part and the large diameter hole part, and an inner periphery face of this waterproof ring is caused to contact with an axle portion between the male thread part and the flange part.

In the desirable mode of this invention, a contact of the waterproof ring in regard to a step and the axle portion of the engagement/disengagement operation body is strengthened by a biasing force of the bias member, so that it is possible to more certainly guarantee the waterproofness about the operation body attachment hole.

Further, in a desirable mode of the present invention, the case barrel part has an operation body attachment hole which comprises a small diameter hole part provided while being brought closer to an inside of the armor case and a large diameter hole part communicating with the small diameter hole part and provided while being brought closer to an outside of the armor case, the engagement/disengagement operation body is formed from an axle part, a taper-like tip part made by one end part of the axle part and capable of pushing the stopper member, a flange part provided in the other end part of axle part, and a lock ring attached to a root of the taper-like tip part and capable of engaging with a case band inner face of the case barrel part, and the engagement/disengagement operation body is attached to the case barrel part by causing the axle part to penetrate through the small diameter hole part to thereby cause the taper-like tip part and the lock ring to dispose in an inside of the case barrel part and providing the flange part in the large diameter hole part, so that the engagement/disengagement operation body is biased toward an outside of the case barrel part by a bias member disposed in the large diameter hole part.

In the desirable mode of this invention, the engagement/disengagement operation body is biased by the bias member such that the lock ring is caught to the case band inner face of the case barrel part. Therefore, after the engagement/disengagement operation body has been pushing-in-operated to a release position in which the stopped member is removed from the stopper engagement part of the movement interlock axle represented by the winding stem, if its pushing-in force is vanished, it is possible by the biasing force of the bias member to automatically return the engagement/disengagement operation body to a position in which the lock ring is caught to the case band inner face of the case barrel part.

Further, in a desirable mode of the present invention, a waterproof ring is attached to an outer periphery of the axle part, and an outer periphery face of this ring is caused to slidably contact with the small diameter hole part.

In the desirable mode of this invention, by the waterproof ring, it is possible to guarantee the waterproofness about the operation body attachment hole.

Further, in a desirable mode of the present invention, under a state in which the lock ring is being caught to the case band inner face, the flange part is disposed while being brought closer to a direction of a step part formed in a boundary between the small diameter hole part and the large diameter hole part in regard to a case band outer face of the case barrel part.

In the desirable mode of this invention, under a state in which the engagement/disengagement operation body is disposed in a position in which the lock ring is caught to the case band inner face of the case barrel part, since the flange part is provided so as to subside in regard to the case band outer face of the case barrel part, the engagement/disengagement operation body is suppressed from moving toward the timepiece movement by the fact that the engagement/disengagement operation body is carelessly pushed to the case band inside and, therefore, there can be made such that the movement interlock axle represented by the winding stem is not removed carelessly.

According to the present invention, in order to remove the stopper member from the stopper engagement part of the movement interlock axle such as winding stem, since it is possible to operate the engagement/disengagement operation body moving the stopper member in the outside of the case barrel part that the armor case of one-piece structure has and from the side, it is possible to provide a portable timepiece in which there has been made such that the constitution for removing, together with the movement interlock axle such as winding stem, the outside operation body such as crown from the timepiece movement does not become the restriction factor in regard to the size of the dial, and the factor impairing the design visually showing the periphery part of the timepiece armor assembly thinly.

BRIEF DESCRIPTION OF THE DRAWINGS

A preferred form of the present invention is illustrated in the accompanying drawings in which.

DETAILED DESCRIPTION OF THE PREFERRED EMBODIMENTS

A first embodiment of the present invention is explained by referring to FIG. 1-FIG. 4.

Figure 1:
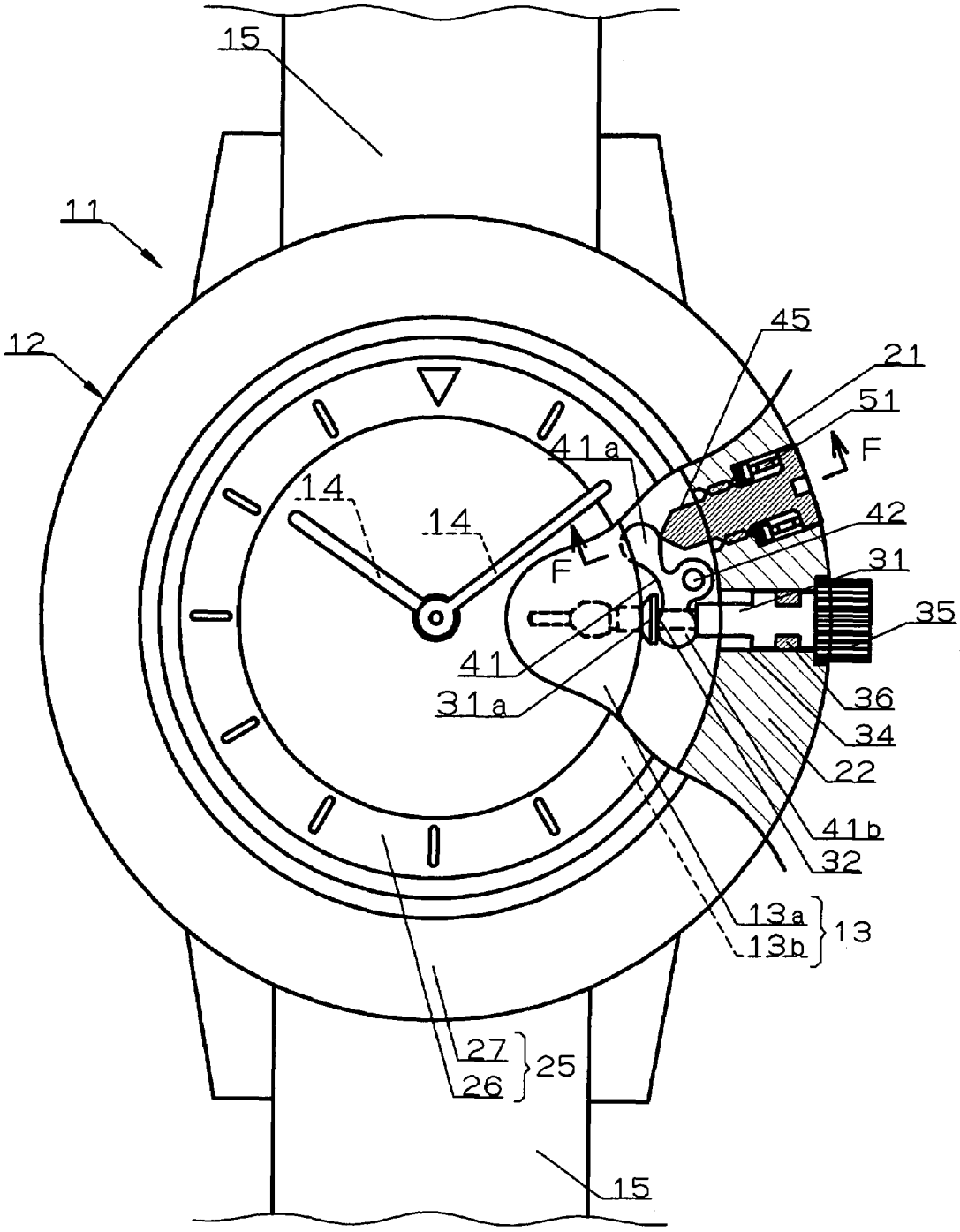
FIG. 1 is a plan view showing a wristwatch, with its one part being cut, concerned with a first embodiment of the present invention.

A reference numeral 11 in FIG. 1 denotes a wristwatch as the portable timepiece. This wristwatch 11 possesses a timepiece armor assembly 12, in which a timepiece movement 13 and the like are accommodated. Incidentally, a reference numeral 15 in FIG. 1 denotes an attachment member such as timepiece band and, by this attachment member 15, the wristwatch 11 is attached to an arm of a human body.

Figure 2:
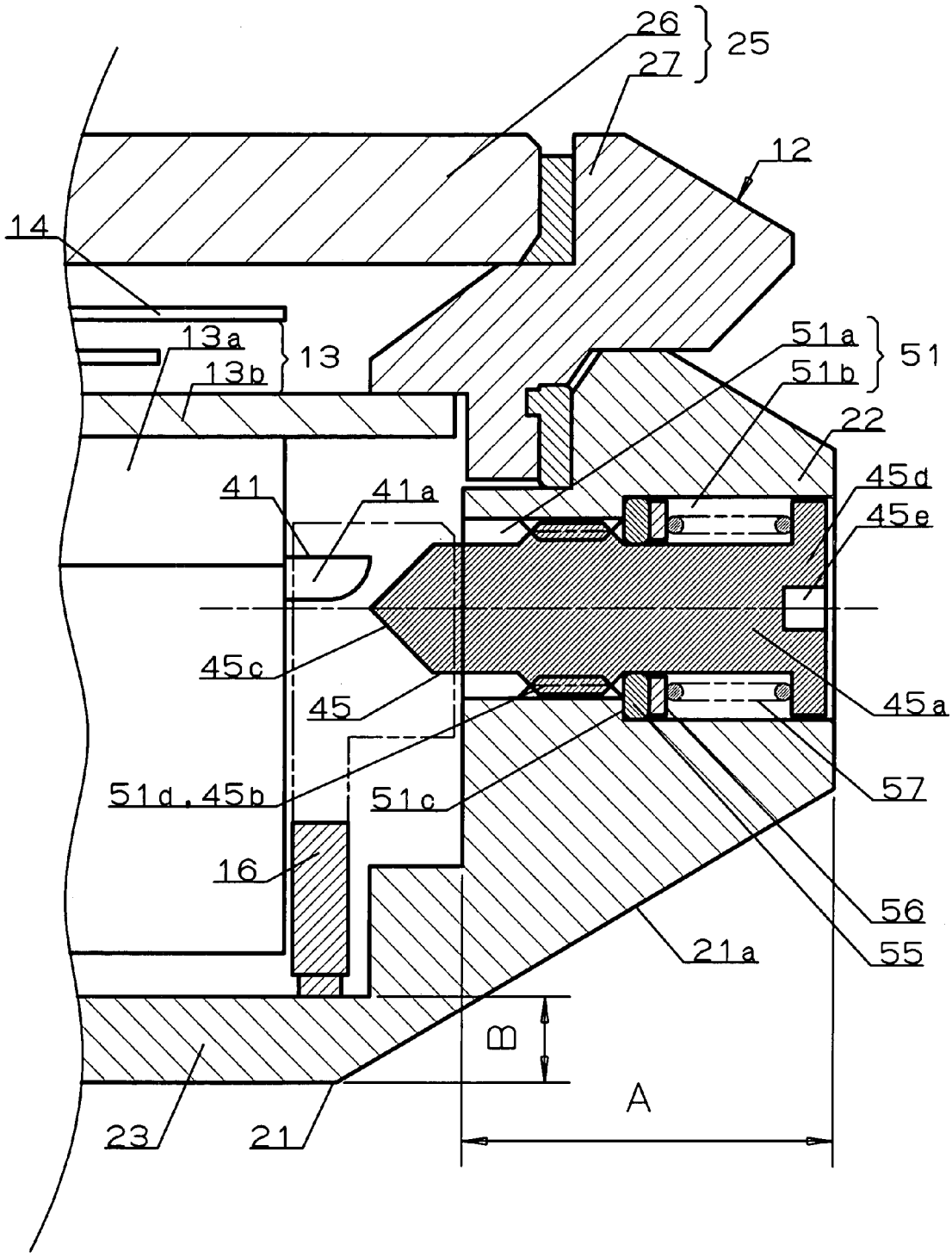
FIG. 2 is a sectional view showing a circumference of an engagement/disengagement operation body, that the wristwatch in FIG. 1 possesses; along an F-F line in FIG. 1 under a state in which this engagement/disengagement operation body exists in a wait position.
Figure 3:
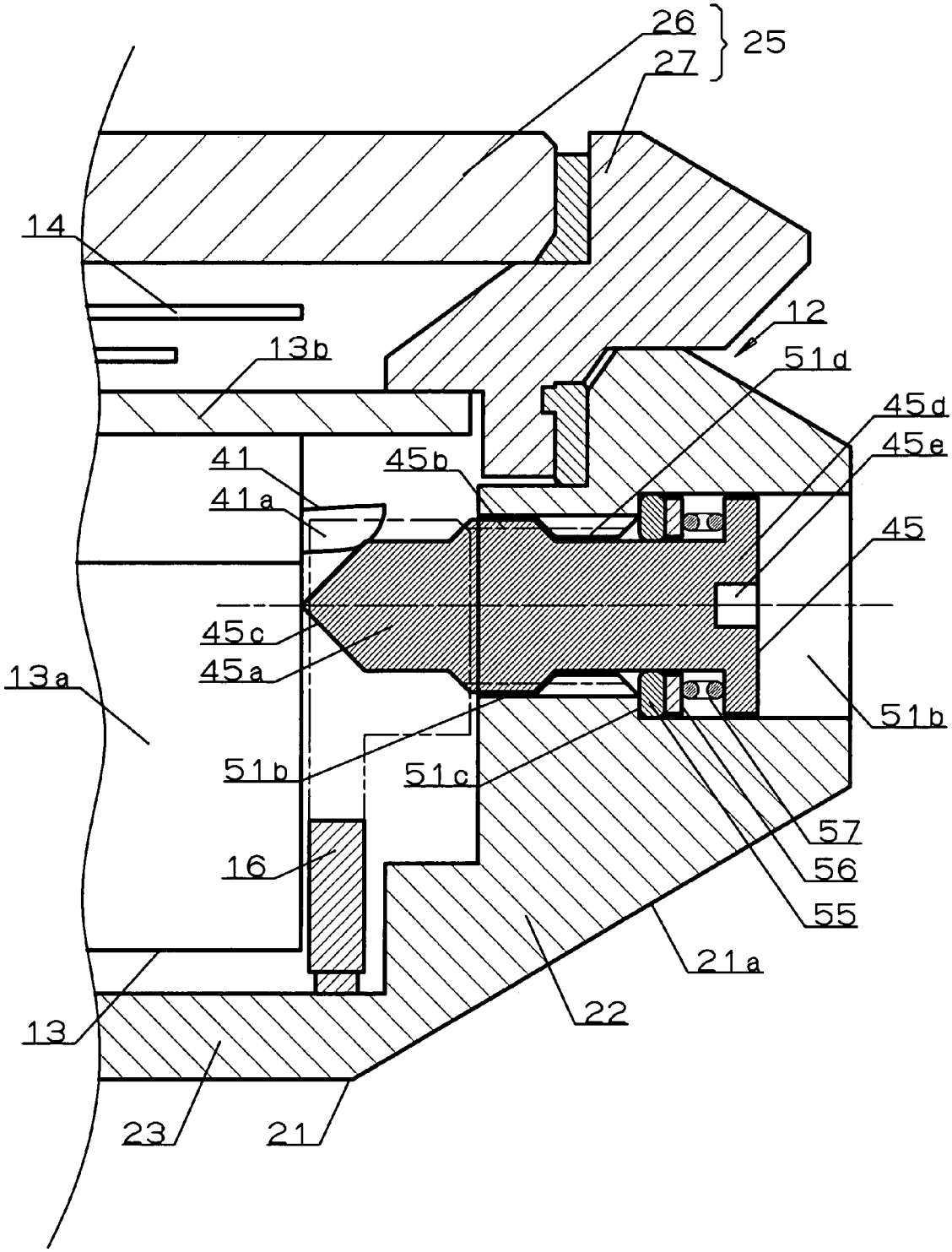
FIG. 3 is a sectional view showing the circumference of the engagement/disengagement operation body, that the wristwatch in FIG. 1 possesses, along the F-F line in FIG. 1 under a state in which this engagement/disengagement operation body exists in a release position.

The timepiece movement 13 possesses a movement main body 13*a*, and a dial 13*b* covering a surface of this movement main body 13*a*. The movement main body 13*a* may be any of one in which a small battery or a mainspring is made a power source, or a self-winding one having the oscillating weight disposed in a side opposite to the dial 13*b* with the movement main body 13*a* being placed between them, or one adapted to a digital timepiece digital-displaying the time instant and the like on the dial 13*b* using a quartz oscillation module, or one in which the one adapted to the digital timepiece and one other than it are used in combination, or the like. The dial 13*b* is larger than the movement main body 13*a* and, as shown in FIG. 2 and FIG. 3, a peripheral part of the dial 13*b* protrudes to a side than an outer periphery of the movement main body 13*a*. Incidentally, a reference numeral 14 denotes a hand of the timepiece, which is moved by the movement 13.

As shown in FIG. 2 and FIG. 3, the timepiece armor assembly 12 possesses an armor case 21, and an armor cover 25 mounted to the timepiece armor assembly.

The armor case 21 forms a concave one-piece structure, and is made by a case barrel part 22 of an annular shape, e.g., a circular annulus shape, and a case bottom wall 23 monolithically provided while closing a back side opening of the case barrel part 22. A wall thickness A of the case barrel part 22 along a radial direction of the timepiece armor assembly 12 is more than several times thicker than a wall thickness B of the case bottom wall 23 along a thickness direction of the timepiece armor assembly 12.

In a peripheral part back face of the armor case 21, there is formed a taper face 21*a* annularly continuing in a circumferential direction. By this taper face 21*a*, since a peripheral part of the timepiece armor assembly 12 becomes thin, it is possible to give an impression in the design, which causes the whole wristwatch 11 to be seen as if it is of a thin type.

The armor case 21 may be obtained by monolithically molding a hard synthetic resin, or may be obtained by shaving a metal such as stainless and titanium. The timepiece movement 13 is accommodated in the armor case 21 through its front opening. Incidentally, a reference numeral 16 in FIG. 2 and FIG. 3 denotes a casing ring having been fixed to the armor case 21 and, by this casing ring 16, the timepiece movement 13 is supported at a predetermined position in the armor case 21.

The armor cover 25 has a transparent member 26 comprising a transparent glass and a transparent synthetic resin or the like, and an annular edge member 27 having supported a peripheral edge part of this transparent member 26. By mounting the edge member 27 to the case barrel part 22, the timepiece armor assembly 12 is assembled with the transparent member 26 covering the dial 13*b*.

As shown in FIG. 1, a movement interlock axle, e.g., a winding stem 31, is built-in in the timepiece armor assembly 12 so as to be movable along a direction intersecting perpendicularly to the thickness direction of this timepiece armor assembly 12, e.g., a radial direction of the timepiece armor assembly 12. The winding stem 31 is connected to the movement main body 13*a* so as to be insertable/removable from its side. The winding stem 31 has in its axial direction intermediate part a stopper engagement part 32. The stopper engagement part 32 is formed by an annular groove continuing in a circumferential direction of the winding stem 31. Under a state in which the winding stem 31 has been connected to the movement main body 13*a* while being inserted, the stopper engagement part 32 is placed in an outside of the movement main body 13*a*.

A reference numeral 31*a* in FIG. 1 denotes a truncated-cone-like part provided while adjoining the stopper engagement 32. This truncated-cone-like part 31*a* is made such that a diameter becomes gradually small as going to one end side of the winding stem 31 disposed in a movement main body 13*a* side.

The other end part of the winding stem 31 is inserted into a winding stem passing hole 34 provided in the case barrel part 22. The winding stem passing hole 34 is formed while penetrating through the case barrel part 22 along the direction intersecting perpendicularly to the thickness direction of the timepiece armor assembly 12, e.g., the radial direction of the timepiece armor assembly 12. The winding stem 31 can be pulled out to the outside of the timepiece armor assembly 12 while passing through this winding stem passing hole 34.

As an external operation body, e.g., a crown 35 is connected to the other end part of the winding stem 31. The greater part of the crown 35 is disposed in an outside of the case barrel part 22. The crown 35 is provided in the case barrel part 22 in the outside of this case barrel part 22 and so as to be detachable from a side. There is made such that, by rotating this crown 35 under a state having been pulled out by a predetermined distance, this rotation is transmitted to the movement main body 13*a* through the winding stem 31 and thus the time instant setting or the like can be performed. Incidentally, a reference numeral 36 in FIG. 1 is a ring shape waterproof gasket mounted to the other end part of the winding stem 31 and slid in the winding stem passing hole 34 and, by this waterproof gasket, there are contrived the waterproofness and a dustproofness in regard to the winding stem passing hole 34.

As shown in FIG. 1, a stopper member 41 placed in an outside of the movement main body 13*a* is built-in in the timepiece armor assembly 12. The stopper member 41 is movable in an upward-downward direction along an axle 42 (i.e., is mounted for undergoing pivotal movement about the axle 42) having supported an intermediate part of the stopper member, and provided with a rotation angle about this axle 42 being limited to a predetermined angle. The stopper member 41 and the axle 42 are disposed, as a desirable example, near the winding stem 31.

The stopper member 41 is one generally referred to also as the lever for setting-lever. This stopper member 41 has, e.g., a passive part 41*a* consisting of its one end part, and an engagement part 41*b* consisting of the other end part. The engagement part 41*b* is a portion engaged with and disengaged from the stopper engagement part 32. There is made such that, when these are in an engagement state as shown in FIG. 1, the stopper member 41 hinders a pulling-out of the winding stem 31 to an outside of the armor case 21, and permits the crown 35 to be pull-moved on the occasion of the time instant setting or the like.

An engagement/disengagement operation body 45 giving a motion, which releases an engagement (catch) of the engagement part 41*b* in regard to the stopper engagement part 32, to the stopper member 41 is attached to the case barrel part 22.

That is, e.g., an operation body attachment hole 51 is provided in the case barrel part 22 while being placed near the winding stem passing hole 34. The operation body attachment hole 51 penetrates through the case barrel part 22 along the direction intersecting perpendicularly to the thickness direction of the timepiece armor assembly 12, e.g., the radial direction of the timepiece armor assembly 12. As shown in FIG. 2 and FIG. 3, the operation body attachment hole 51 comprises a stepped hole having a small diameter hole part 51*a* and a large diameter hole part 51*b* communicated with the former and, between the small diameter hole part 51*a* and the large diameter hole part 51*b*, there is formed a step part 51*c* forming a boundary of them.

Figure 4:
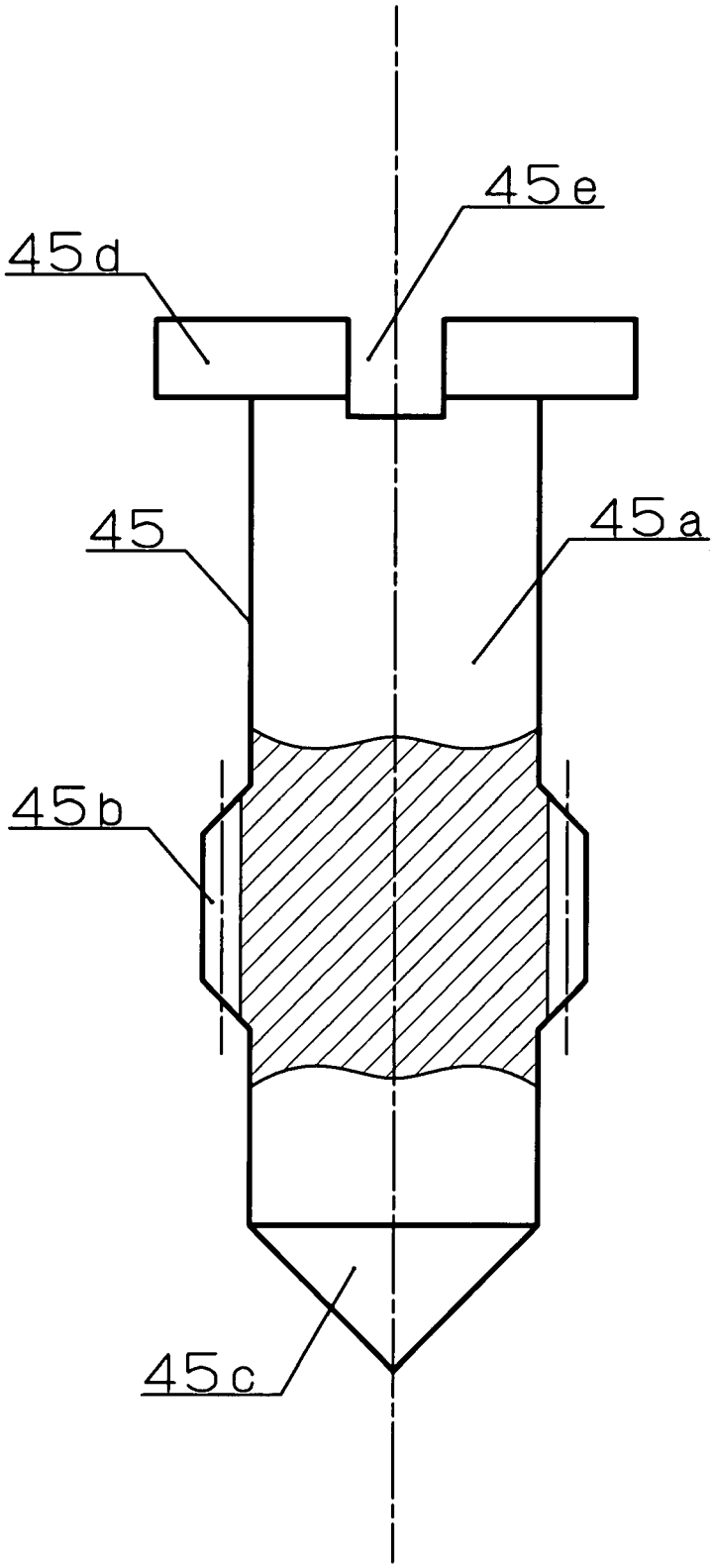
FIG. 4 is a side view showing the engagement/disengagement operation body, with its one part being sectioned, that the wristwatch in FIG. 1 possesses.

The small diameter hole part 51*a* is provide while being brought closer to an inside of the armor case 21, and opened to this inside. The large diameter hole part 51*b* is provided while being brought closer to an outside of the armor case 21, and opened to the outside of the armor case 21. An inner face, of the small diameter hole part 51*a*, adjoining the step part 51*c* is protruded into the small diameter hole part 51*a*, and a female thread part 51*d* is formed in that portion The engagement/disengagement operation body 45 causing the stopper member 41 to follow forms, together with the stopper member 41, an interlock axle attachment/detachment mechanism, e.g., a winding stem attachment/detachment mechanism, which makes it possible to insert/remove the winding stem 31 (i.e., the movement interlock axle) from a side in regard to the timepiece movement 13. This engagement/disengagement operation body 45 is made of a metal or a synthetic resin and, as shown in FIG. 4 and the like, has an axle part 45*a*, a male thread part 45*b*, a taper-like tip part 45*c*, a flange part 45*d*, and an operation part 45*e*.

The axle part 45*a* comprises a straight axle having a diameter capable of penetrating trough an inside of the female thread part 51*d*. The male thread part 45*b* is formed in an intermediate part outer periphery of the axle part 45*a* with a length approximately the same length as a length of the female thread part 51*d*, and detachably meshed with the female thread part 51*d*. The taper-like tip part 45*c* is made by one end part of the axle part 45*a*, and formed like a circular cone for instance. The flange part 45*d* is formed in the other end part of the axle part 45*a* while protruding from its outer periphery. A diameter of the flange part 45*d* is slightly smaller than a diameter of the large diameter hole part 51*b*. The operation part 45*e* is provided in the flange part 45*d* and formed, e.g., by a slitting groove traversing the flange part 45*d*. There is made such that, by inserting a tip of a tool into this operation part 45*e*, the engagement/disengagement operation body 45 is rotation-operated.

As shown in FIG. 2 and FIG. 3, the engagement/disengagement operation body 45 is attached to the case barrel part 22 by meshing the male thread part 45*b* with the female thread part 51*d*, penetrating the axle part 45*a* through the small diameter hole part 51*a*, and disposing the flange part 45*d* in the large diameter hole part 51*b*. By rotating this engagement/disengagement operation body 45 to thereby change a mesh with the female thread part 51*d*, the engagement/disengagement operation body 45 is reciprocation-moved between a first position (wait position) shown in FIG. 2 and a second position (release position) shown in FIG. 3 along the radial direction of the timepiece armor assembly 12.

A state in which the engagement/disengagement operation body 45 disposed in the first position is a normal disposition state. There is made such that, under this state, the taper-like tip part 45*c* of the engagement/disengagement operation body 45 is opposed to the passive part 41*a* of the stopper member 41 while adjoining, and the flange part 45*d* does not protrude to an outside from the large diameter hole part 51*b*. A state in which the engagement/disengagement operation body 45 has been disposed in the second position is selected when disassembling the wristwatch 11. There is made such that, in this case, the taper-like tip part 45*c* of the engagement/disengagement operation body 45 pushes the passive part 41*a* in an upward or downward direction, thereby pushing up the stopper member 41 for instance.

In the step part 51*c*, there is disposed a waterproof ring 55 capable of elastically deforming, and an inner periphery face of the waterproof ring 55 is contacted with an outer periphery of an axle portion between the male thread part 45*b* and the flange part 45*d*. By this waterproof ring 55, there are contrived the waterproofness and the dustproofness around the operation body attachment hole 51. A spring reception ring 56 is overlapped to the waterproof ring 55 and, between this spring reception ring 56 and the flange part 45*d*, a coil spring 57 for instance is nipped as a bias body while maintaining a state having elastically deformed. Accordingly, by the coil spring 57 disposed in the large diameter part 51*b*, the engagement/disengagement operation body 45 is biased toward the outside of the armor case 21 so as to separate from the timepiece movement 13. By transmitting a force of the coil spring 57 to the waterproof ring 55 through the spring reception ring 56, contacts of the waterproof ring 55 to the step part 51*c* and the axle part 45*a* can be made more certainly.

A correlation between the engagement/disengagement operation body 45 and the stopper member 41 under a normal state in which the wristwatch 11 is carried is shown in FIG. 2. Under this state, since the axle part 45*a* of the engagement/disengagement operation body 45 maintains a state in which the axle part 45*a* is separated from the passive part 41*a* of the stopper member 41 and the stopper member 41 exists in a position having descended by its own weight or the like, the engagement part 41*b* of the stopper member 41 fits from above for instance to the stopper engagement part 32 of the winding stem 31 and is caught. Therefore, the winding stem 31 is retained by the stopper member 41, not so as to move to a pulling out direction.

In a case performing a crown operation such as time instant setting, there suffices if, after the winding stem 31 is first pulled out by one stage through the crown 35, the crown is rotation-operated. By this, it is possible to perform the time instant setting or the like by giving the rotation of the crown 35 to the movement main body 13*a* through the winding stem 31. Incidentally, at this time, although the stopper member 41 slightly rotates about the axle 42 while following an axial displacement of the winding stem 31, the engagement part 41*b* is still caught intact while fitting to the stopper engagement part 32 of the winding stem 31.

Further, when disassembling the wristwatch 11, in a case where the winding stem 31 is pulled out from the timepiece movement 13, the engagement/disengagement operation body 45 is rotated in a screwing direction by inserting the tool to the operation part 45*e* of the engagement/disengagement operation body 45 from the outside of the armor case 21. On the basis of a change, in the mesh, due to it between the male thread part 45*b* of the engagement/disengagement operation body 45 and the case barrel part 22, the engagement/disengagement operation body 45 is moved toward the timepiece movement 13. As shown in FIG. 3, this movement is stopped by the fact that, just after the male thread part 45*b* has been inserted through the female thread part 51*d*, the taper-like tip part 45*c* of the axle part 45*a* collides against an outer side face of the movement main body 13*a*, and perceived by a worker. Under this state, although a spring force of the coil spring 57 is strengthened, since the male thread part 45*b* is caught to the female thread part 51*d*, there is no fact that the engagement/disengagement operation body 45 comes out.

And, by the above pushing-in operation of the engagement/disengagement operation body 45, since the taper-like tip part 45*c* of the axle part 45*a* pushes the passive part 41*a* of the stopper member 41 and the whole stopper member 41 is ascended, the engagement part 41*b* of the stopper member 41 is removed from the stopper engagement part 32 of the winding stem 31. Accordingly, under a state in which a restraint of the movement in regard to the axial direction of the winding stem 31 has been released in this manner, by pull-moving the winding stem 31 together with the crown 35, it is possible to cause the winding stem 31 to break away from the movement main body 13*a* and pull out it to the outside of the armor case 21 while passing through the winding stem passing hole 34. The pulling-out of the winding stem 31 in this manner can be performed also under a complete state before removing the armor cover 25, or also under a state in which the armor cover 25 has been removed.

Incidentally, after this, the engagement/disengagement operation body 45 is rotation-operated in a direction reverse to the above procedures, and returned till the wait position shown in FIG. 2. Further, on the occasion of an assembly after the disassembly of the wristwatch 11, if the winding stem 31 is inserted through the winding stem passing hole 34, just before the winding stem 31 is inserted into and connected to the movement main body 13*a*, the truncated-cone-like part 31*a* of the winding stem 31 pushes up the engagement part 41*b*. By this, since the engagement part 41*b* climbs over the truncated-cone-like part 31*a*, just after this, the winding stem 31 is connected to the movement main body 13*a*, and the engagement part 41*b* falls into the stopper engagement part 32 and is caught.

Like the above, since the engagement/disengagement operation body 45 releasing the retention of the winding stem 31 is not moved along the thickness direction of the armor case 21 of one-piece structure, in other words, toward a back side from a front side, or from the back side toward the front side, but moved along the radial direction of the timepiece armor assembly 12 from the outside of the case barrel part 22 of the armor case 21, it is possible to regardlessly provide this engagement/disengagement operation body 45 without being restricted by the dial 13*b*. By this, since there is no fact that the engagement/disengagement operation body 45 gives the restriction to the size of the dial 13*b* and thus a degree of freedom in the size of the dial 13*b* is increased, following upon it, it can be facilitated to provide the wristwatch 11 of various modes in which the size of the dial 13*b* has been caused to differ.

Moreover, even in a case where the present invention is applied to the self-winding wristwatch 11 in which the timepiece movement possessing the oscillating weight, there is no fact that a disposition of the engagement/disengagement operation body 45 becomes a problem about the fact that the taper face 21*a* is provided in a peripheral part back side of the armor case 21 that is one-piece structure. By this, it is possible to constitute the self-winding type wristwatch 11 in which there is made the design having thinly formed the peripheral part of the timepiece armor assembly 12.

Accordingly, in the timepiece armor assembly 12 of a certain limited size, it is possible to make the wristwatch 11 in which the dial 13*b* is relatively large, the peripheral part of the timepiece armor assembly 12 is thin and, therefore, it can be seen thinly in the design. Further, from a necessity for disposing the winding stem 31 and the crown 35, the wall thickness A of the case barrel part 22 along the radial direction of the timepiece armor assembly 12 is sufficiently, thickly formed in comparison with the wall thickness B of the case bottom wall 23, so that there is no necessity to particularly ensure, in the case barrel part 22, a wall thickness for attaching the engagement/disengagement operation body 45 to this case barrel part 22. By this, a diameter of the timepiece armor assembly 12 does not become large.

Additionally, in the wristwatch 11, by biasing the engagement/disengagement operation body 45 meshed with the case barrel part 22 by the coil spring 57, a mesh state of the engagement/disengagement operation body 45 to the case barrel part 22 is retained. Therefore, even if a vibration or an impact is exerted on the wristwatch 11, or even if the flange part 45*d* is carelessly pushed to a case band inside, the engagement/disengagement operation body 45 is suppressed from moving toward the timepiece movement 13. By this, except when contriving the disassembly of the wristwatch 11, there is no fact that the stopper member 41 is carelessly pushed by the taper-like tip part 45*c* of the engagement/disengagement operation body 45. Accordingly, there can be made such that the winding stem 31 is not removed carelessly.

Figure 5:
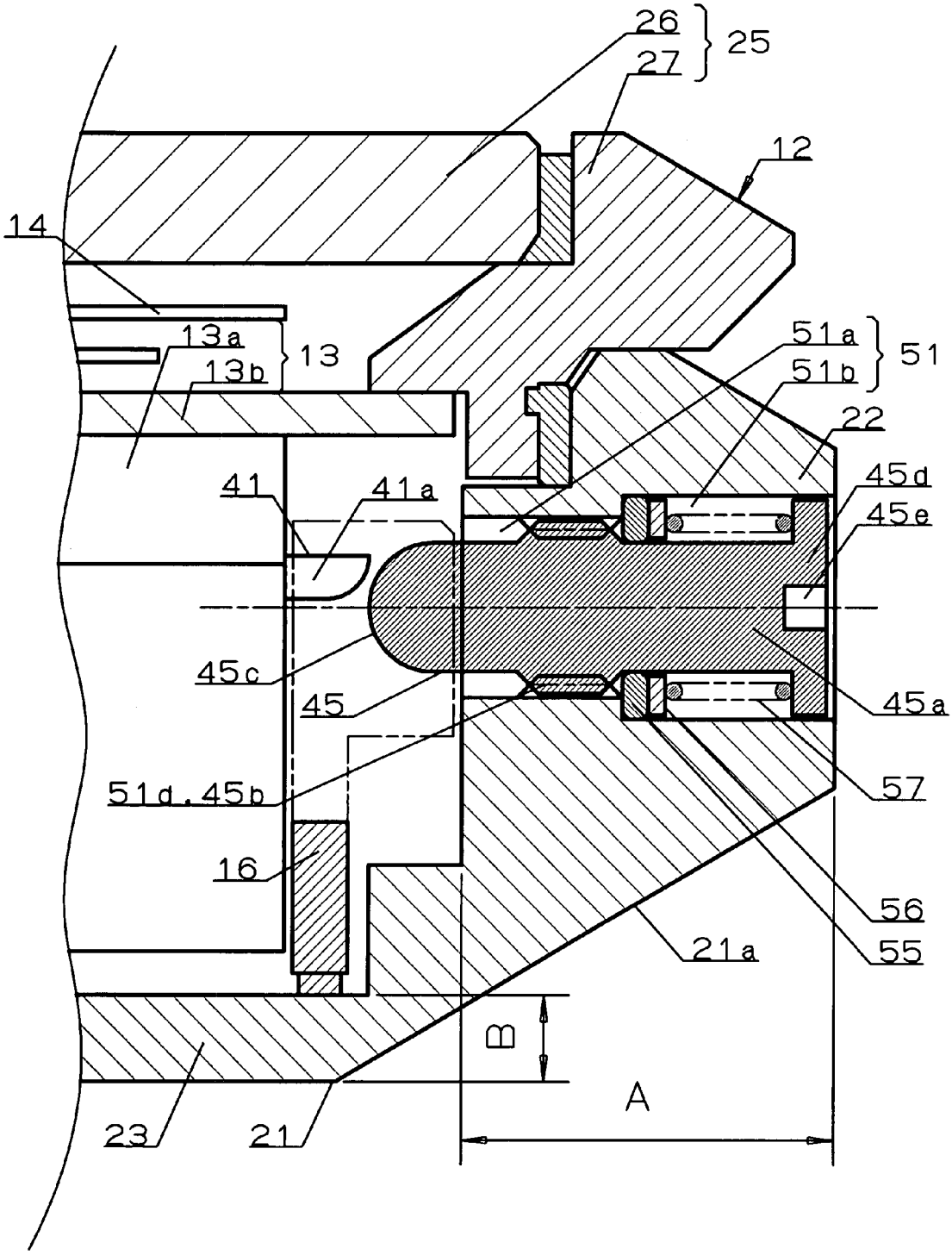
FIG. 5 is a sectional view showing a circumference of an engagement/disengagement operation body, that a wristwatch concerned with a second embodiment of the present invention possesses, under the state in which this engagement/disengagement operation body exists in the wait position.

FIG. 5 shows a second embodiment of the present invention. In this second embodiment, the taper-like tip part 45*c* of the engagement/disengagement operation body 45 is formed like a hemisphere. Since matters other than this point are the same as the first embodiment including portions not shown in FIG. 5, the object of the present invention can be achieved also in the second embodiment. In FIG. 5, about the same constitution as that of the first embodiment, there is applied the same reference numeral as that the first embodiment.

Figure 6:
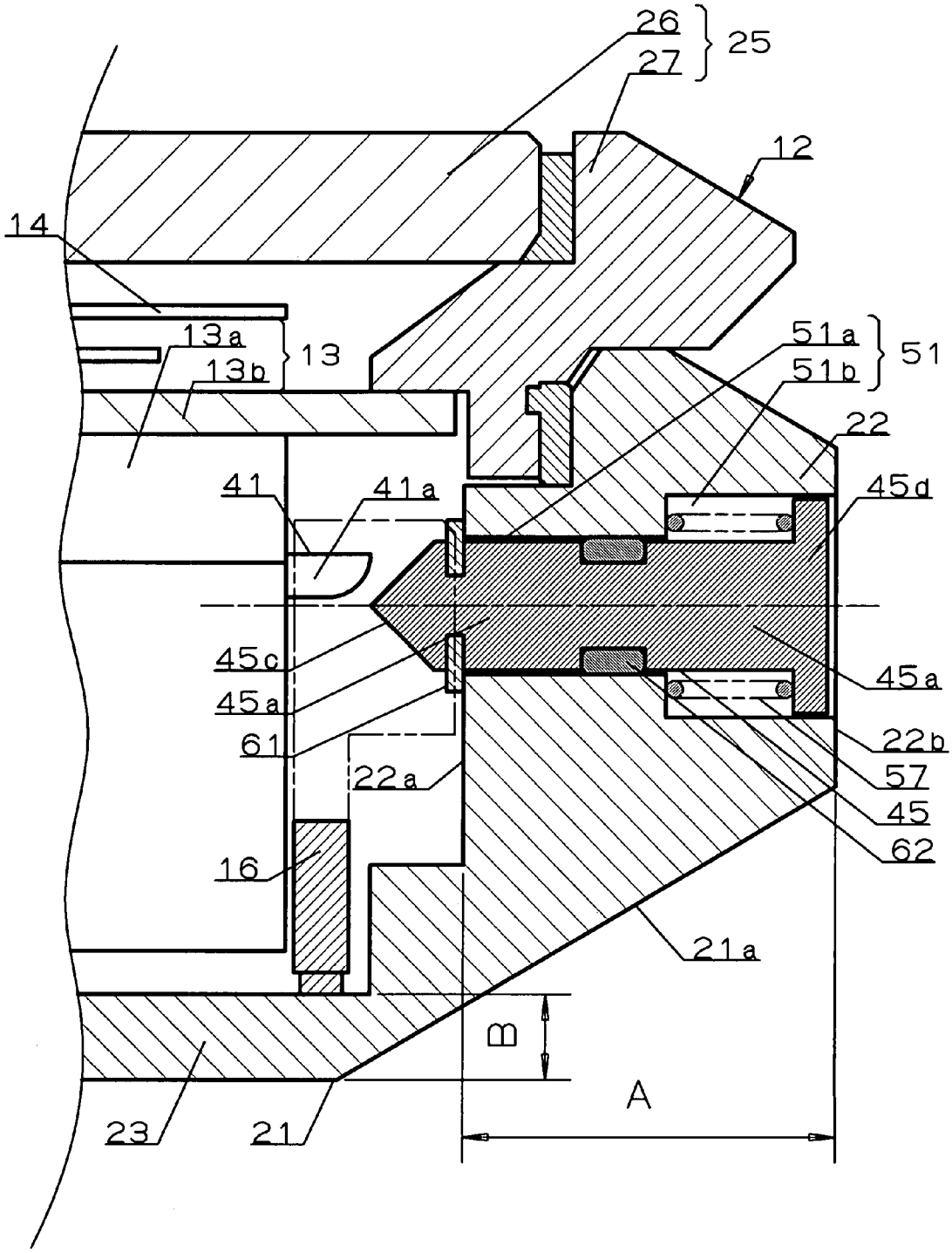
FIG. 6 is a sectional view showing a circumference of an engagement/disengagement operation body, that a wristwatch concerned with a third embodiment of the present invention possesses, under the state in which this engagement/disengagement operation body exists in the wait position.

FIG. 6 shows a third embodiment of the present invention.

In this third embodiment, the operation body attachment hole 51 provided in the case barrel part 22 is formed from the small diameter hole part 51*a* in which there is no female thread part in the inner face, and the large diameter hole part 51*b* communicated with the former. Further, the engagement/disengagement operation body 45 is formed from the axle part 45*a*, the taper-like tip part 45*c*, the flange part 45*d*, and a lock ring 61. The lock ring 61 is attached to a root of the taper-like tip part 45*c*, and protrudes from the outer periphery. In this engagement/disengagement operation body 45, the male thread part 45*b* and the operation part 45*e*, which have been explained in the first embodiment, are omitted.

To an intermediate part outer periphery of the axle part 45*a* of the engagement/disengagement operation body 45, there is attached a waterproof ring 62 capable of elastically deforming The waterproof ring 62 is slidably contacted with the inner face of the small diameter hole part 51*a*, and the waterproof ring 62 and the spring reception ring 56, which have been explained in the first embodiment, are omitted. By the waterproof ring 62, there are guaranteed the waterproofness and the dustproofness as to the operation body attachment hole 51.

The engagement/disengagement operation body 45 is attached to the case barrel part 22 by, under a state in which the lock ring 61 is not attached, penetrating the taper-like tip part 45*c* from the large diameter hole part 51*b* toward the small diameter hole part 51*a* while nipping the coil spring 57 between the flange part 45*d* and the step part 51*c*, and thereafter mounting the lock ring 61 to the axle part 45*a* in the inside of the armor case 21. Under this attachment state, by the elastic force of the coil spring 57, since the engagement/disengagement operation body 45 is biased toward the outside of the case barrel part 22, the lock ring 61 is caught to a case band inner face 22*a* of the case barrel part 22. Additionally, under the above attachment state, there is made such that the flange part 45*d* does not protrude from a case band outer face 22*b* of the case barrel part 22 by being brought closer to the case band outer face 22*b* in a step part 51*c* direction.

Incidentally, since matters other than those having been explained above are the same as the first embodiment including portions not shown in FIG. 6, the object of the present invention can be achieved also in the third embodiment. In FIG. 6, about the same constitution as that of the first embodiment, there is applied the same reference numeral as that of the first embodiment.

In this third embodiment, when disassembling the wristwatch 11, in the case where the winding stem 31 is pulled out from the timepiece movement 13, the engagement/disengagement operation body 45 is moved by being pushed to a timepiece movement 13 direction while resisting against a biasing force of the coil spring 57. This movement is stopped to a release position by the fact that the taper-like tip part 45*c* of the axle part 45*a* collides against the outer side face of the movement main body 13*a*, and perceived by the worker.

By such a pushing-in operation, since the taper-like tip part 45*c* of the axle part 45*a* pushes the passive part 41*a* of the stopper member 41 and the whole stopper member 41 is ascended, the engagement part 41*b* of the stopper member 41 is removed from the stopper engagement part 32 of the winding stem 31. Accordingly, under the state in which the restraint of the movement in regard to the axial direction of the winding stem 31 has been released in this manner, by pull-moving the winding stem 31 together with the crown 35, it is possible to cause the winding stem 31 to break away from the movement main body 13*a* and pull out it to the outside of the armor case 21 while passing through the winding stem passing hole 34. The pulling-out of the winding stem 31 in this manner can be performed also under the complete state before removing the armor cover 25, or also under the state in which the armor cover 25 has been removed.

After this, if a pushing-in operation force to the engagement/disengagement operation body 45 is vanished, the engagement/disengagement operation body 45 is automatically returned by the biasing force of the coil spring 57 and, at a time point, in which the engagement/disengagement operation body 45 is returned till a wait position shown in FIG. 6, there is no fact that the engagement/disengagement operation body 45 comes out because the lock ring 61 is caught to the case band inner face 22*a* of the case barrel part 22.

And, under a normal state of the wristwatch 11, although the engagement/disengagement operation body 45 is disposed in the wait position, since its flange part 45*d* is brought closer to a step part 51*c* side direction of the operation body attachment hole 51 so as to subside in regard to the case band outer face 22*b*, the engagement/disengagement operation body 45 is suppressed from being carelessly pushed to the case band inside. By this, since the engagement/disengagement operation body 45 is suppressed from moving toward the timepiece movement 13, there can be made such that the winding stem 31 is not removed carelessly.

What is claimed is:

1. A portable timepiece comprising:

a timepiece armor assembly comprised of an armor case having a case bottom wall and a case barrel part formed monolithically to provide a one-piece structure, the armor case having a taper face formed in a peripheral part back face thereof;

a timepiece movement disposed in the timepiece armor assembly, the timepiece movement having a dial;

a movement interlock axle connected to the timepiece movement and configured to be insertable/removable from a side of the timepiece armor assembly so as to be movable in a direction intersecting a thickness direction of the timepiece armor assembly, the movement interlock axle having a stopper engagement part;

an external operation body connected to the case barrel part so as to be detachable from a side thereof while being connected to the movement interlock axle;

a stopper member disposed in the timepiece armor assembly; and an engagement/disengagement operation body disposed in the case barrel part so as to be operable from a side of the case barrel part for undergoing movement in a first direction intersecting the thickness direction of the timepiece armor assembly to engage the stopper member and cause the stopper member to engage with the stopper engagement part of the movement interlock axle, and for undergoing movement in a second direction in which the engagement/disengagement operation body is disengaged from the stopper member to cause the stopper member to disengage from the stopper engagement part of the movement interlock axle.

2. A portable timepiece according to claim 1; wherein:

the case barrel part has an operation body attachment hole including a small diameter hole part provided while being brought closer to an inside of the armor case and a large diameter hole part communicating with the small diameter hole part and provided while being brought closer to an outside of the armor case, the small diameter hole part having a female threaded part form in an inner face thereof;

the engagement/disengagement operation body has an axle part, a male thread part provided in an intermediate part outer periphery of the axle part, a taper-like tip part formed by one end part of the axle part and capable of pushing the stopper member, a flange part provided in the other end part of axle part, and an an operation part disposed on the other end part of the axle part and via which the engagement/disengagement operation body is rotated; and the engagement/disengagement operation body is attached to the case barrel part by causing the male thread part to mesh with the female thread part of the small diameter hole of the case barrel part to thereby cause the axle part to penetrate through the small diameter hole part and provide the flange part in the large diameter hole part, so that the engagement/disengagement operation body is biased toward an outside of the case barrel part by a bias member disposed in the large diameter hole part.

3. A portable timepiece according to claim 2; wherein a waterproof ring biased by the bias member is disposed in a step part formed in a boundary between the small diameter hole part and the large diameter hole part, and an inner periphery face of the waterproof ring is caused to contact with an axle portion between the male thread part and the flange part.

4. A portable timepiece according to claim 1; wherein:

the case barrel part has an operation body attachment hole including a small diameter hole part provided while being brought closer to an inside of the armor case and a large diameter hole part communicating with the small diameter hole part and provided while being brought closer to an outside of the armor case;

the engagement/disengagement operation body is formed from an axle part, a taper-like tip part made by one end part of the axle part and capable of pushing the stopper member, a flange part provided in the other end part of axle part, and a lock ring attached to a root of the taper-like tip part and capable of engaging with a case band inner face of the case barrel part; and the engagement/disengagement operation body is attached to the case barrel part by causing the axle part to penetrate through the small diameter hole part to thereby cause the taper-like tip part and the lock ring to dispose in an inside of the case barrel part and provide the flange part in the large diameter hole part, so that the engagement/disengagement operation body is biased toward an outside of the case barrel part by a bias member disposed in the large diameter hole part.

5. A portable timepiece according to claim 4; wherein a waterproof ring is attached to an outer periphery of the axle part, and an outer periphery face of the waterproof ring is caused to slidably contact with the small diameter hole part.

6. A portable timepiece according to claim 5; wherein under a state in which the lock ring is being caught to the case band inner face, the flange part is disposed while being brought closer to a direction of a step part formed in a boundary between the small diameter hole part and the large diameter hole part relative to a case band outer face of the case barrel part.

7. A portable timepiece according to claim 1; wherein the stopper member is mounted in the timepiece armor assembly to undergo pivotal movement between a first position in which the stopper member is engaged with the stopper engagement part of the movement interlock axle and a second position in which the stopper member is not engaged with the stopper engagement part of the movement interlock axle.

8. A portable timepiece according to claim 1; wherein the engagement/disengagement operation body is not integrally connected to the stopper member.

9. A portable timepiece according to claim 1; wherein the engagement/disengagement operation body has a structure separate and independent from that of the stopper member.

10. A portable timepiece comprising:

a timepiece armor assembly comprised of an armor case having a case bottom wall and a case barrel part formed monolithically to provide a one-piece structure, the armor case having a taper face formed in a peripheral part back face thereof;

a timepiece movement disposed in the timepiece armor assembly, the timepiece movement having a dial;

a winding stem connected to the timepiece movement and configured to be insertable/removable from a side of the timepiece armor assembly so as to be movable in a direction intersecting a thickness direction of the timepiece armor assembly, the movement interlock axle having a stopper engagement part;

a crown connected to the case barrel part so as to be detachable from a side thereof while being connected to the winding stem;

a stopper member disposed in the timepiece armor assembly; and an engagement/disengagement operation body disposed in the case barrel part so as to be operable from a side of the case barrel part for undergoing movement in a first direction intersecting the thickness direction of the timepiece armor assembly to engage the stopper member and cause the stopper member to engage with the stopper engagement part of the winding stem, and for undergoing movement in a second direction in which the engagement/disengagement operation body is disengaged from the stopper member to cause the stopper member to disengage from the stopper engagement part of the winding stem.

11. A portable timepiece according to claim 10; wherein:

the case barrel part has an operation body attachment hole including a small diameter hole part provided while being brought closer to an inside of the armor case and a large diameter hole part communicating with the small diameter hole part and provided while being brought closer to an outside of the armor case, the small diameter hole part having a female threaded part form in an inner face thereof;

the engagement/disengagement operation body has an axle part, a male thread part provided in an intermediate part outer periphery of the axle part, a taper-like tip part formed by one end part of the axle part and capable of pushing the stopper member, a flange part provided in the other end part of axle part, and an operation part disposed on the other end part of the axle part and via which the engagement/disengagement operation body is rotated; and the engagement/disengagement operation body is attached to the case barrel part by causing the male thread part to mesh with the female thread part of the small diameter hole of the case barrel part to thereby cause the axle part to penetrate through the small diameter hole part and provide the flange part in the large diameter hole part, so that the engagement/disengagement operation body is biased toward an outside of the case barrel part by a bias member disposed in the large diameter hole part.

12. A portable timepiece according to claim 11; wherein a waterproof ring biased by the bias member is disposed in a step part formed in a boundary between the small diameter hole part and the large diameter hole part, and an inner periphery face of the waterproof ring is caused to contact with an axle portion between the male thread part and the flange part.

13. A portable timepiece according to claim 10; wherein:

the case barrel part has an operation body attachment hole including a small diameter hole part provided while being brought closer to an inside of the armor case and a large diameter hole part communicating with the small diameter hole part and provided while being brought closer to an outside of the armor case;

the engagement/disengagement operation body is formed from an axle part, a taper-like tip part made by one end part of the axle part and capable of pushing the stopper member, a flange part provided in the other end part of axle part, and a lock ring attached to a root of the taper-like tip part and capable of engaging with a case band inner face of the case barrel part; and the engagement/disengagement operation body is attached to the case barrel part by causing the axle part to penetrate through the small diameter hole part to thereby cause the taper-like tip part and the lock ring to dispose in an inside of the case barrel part and provide the flange part in the large diameter hole part, so that the engagement/disengagement operation body is biased toward an outside of the case barrel part by a bias member disposed in the large diameter hole part.

14. A portable timepiece according to claim 13; wherein a waterproof ring is attached to an outer periphery of the axle part, and an outer periphery face of the waterproof ring is caused to slidably contact with the small diameter hole part.

15. A portable timepiece according to claim 14; wherein under a state in which the lock ring is being caught to the case band inner face, the flange part is disposed while being brought closer to a direction of a step part formed in a boundary between the small diameter hole part and the large diameter hole part relative to a case band outer face of the case barrel part.

16. A portable timepiece according to claim 2; wherein the stopper member is mounted in the timepiece armor assembly to undergo pivotal movement between a first position in which the stopper member is engaged with the stopper engagement part of the winding stem and a second position in which the stopper member is not engaged with the stopper engagement part of the winding stem.

17. A portable timepiece according to claim 10; wherein the engagement/disengagement operation body is not integrally connected to the stopper member.

18. A portable timepiece according to claim 10; wherein the engagement/disengagement operation body has a structure separate and independent from that of the stopper member.

19. A portable timepiece comprising:

a timepiece armor assembly having an armor case;

a timepiece movement disposed in the timepiece armor assembly;

a movement interlock axle mounted to the armor case for undergoing linear movement in a direction intersecting a thickness direction of the timepiece armor assembly and for undergoing rotational movement to transmit a rotational force to the timepiece movement, the movement interlock axle having an engagement part;

an external operation body connected to the movement interlock axle and operable to linearly move and rotate the movement interlock axle;

a stopper member mounted in the timepiece armor assembly for undergoing movement between a first position in which the stopper member is engaged with the engagement part of the movement interlock axle to prevent linear movement of the movement interlock axle and a second position in which the stopper member is not engaged with the engagement part of the movement interlock axle to permit linear movement of the movement interlock axle; and an operation body mounted to the armor case for undergoing movement in a first direction intersecting the thickness direction of the timepiece armor assembly to engage the stopper member and cause the stopper member to move to the first position thereof to engage the engagement part of the movement interlock axle, and for undergoing movement in a second direction in which the operation body is disengaged from the stopper member to cause the stopper member to move to the second position thereof to disengage from the engagement part of the movement interlock axle.

20. A portable timepiece according to claim 19; wherein the stopper member is mounted in the timepiece armor assembly for undergoing pivotal movement between the first and second positions thereof.

* * * * *